US007111488B2

(12) United States Patent
Lefavour et al.

(10) Patent No.: US 7,111,488 B2
(45) Date of Patent: Sep. 26, 2006

(54) BATTERY POWERED HYDRAULIC TOOL

(75) Inventors: John D. Lefavour, Litchfield, NH (US); Christopher G. Chadbourne, Nashua, NH (US); Armand T. Montminy, Manchester, NH (US); Gordon L. Steltzer, New Boston, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/158,735

(22) Filed: Jun. 21, 2005

(65) Prior Publication Data

US 2005/0229671 A1 Oct. 20, 2005

Related U.S. Application Data

(60) Division of application No. 10/818,196, filed on Apr. 5, 2004, now Pat. No. 6,957,560, which is a continuation of application No. 10/080,281, filed on Feb. 19, 2002, now Pat. No. 6,745,611.

(51) Int. Cl.
*B21J 9/14* (2006.01)
*B21J 9/18* (2006.01)
*B21D 7/06* (2006.01)

(52) U.S. Cl. ..... 72/453.16; 72/453.03; 72/453.15; 30/180; 29/751; 60/477; 60/479

(58) Field of Classification Search ..... 72/453.02, 72/453.03, 453.15, 453.16; 30/180; 29/751; 60/477, 479
See application file for complete search history.

(56) References Cited

U.S. PATENT DOCUMENTS 5,113,679 A 5/1992 Ferraro et al. ..... 72/21
5,130,700 A 7/1992 Annis et al. ..... 340/665
5,309,751 A 5/1994 Ryan ..... 72/450
5,553,478 A 9/1996 Di Troia ..... 72/453.15
5,657,417 A 8/1997 Di Troia ..... 388/829
5,711,078 A 1/1998 Pattron et al. ..... 30/228
5,727,417 A 3/1998 Moffatt ..... 72/453.03
5,979,215 A 11/1999 Lefavour et al. ..... 72/453.16
6,075,341 A 6/2000 White et al. ..... 320/114
6,138,346 A 10/2000 Shutts et al. ..... 29/758
6,237,698 B1 5/2001 Carrier et al. ..... 173/2
6,276,186 B1 8/2001 Frenken ..... 72/453.15
6,276,627 B1 8/2001 Brodock ..... 242/390.8
6,304,058 B1 10/2001 Warson et al. ..... 320/117

(Continued)

OTHER PUBLICATIONS

"Presse Hydraulique Sur Batterie 14,4V ou 18V Ni-MH" Bubuis Outillages, 4 pages, Dec. 2001.

(Continued)

*Primary Examiner*—David Jones
(74) *Attorney, Agent, or Firm*—Harrington & Smith, LLP

(57) ABSTRACT

A battery powered hydraulic tool including a frame; a battery connected to the frame; a motor connected to the frame and adapted to be powered by the battery; and a hydraulic pump connected to the motor by a gear reduction transmission. The motor and gear reduction transmission are adapted to output a torque of the least about 160 oz-in with the gear reduction transmission being adapted to provide a gear reduction of between about 8:1 to about 15:1 or less, and the hydraulic pump being adapted to output at least about 6000 psi of pressure or more.

19 Claims, 3 Drawing Sheets

U.S. PATENT DOCUMENTS

| | | | | |
|---|---|---|---|---|
| 6,309,151 | B1 | 10/2001 | Sacchetti | 409/131 |
| 6,446,482 | B1 | 9/2002 | Heskey et al. | 72/453.16 |
| 6,453,719 | B1 | 9/2002 | Heskey et al. | 72/453.16 |
| 6,668,613 | B1 | 12/2003 | Lefavour et al. | 72/453.03 |
| 6,745,611 | B1 | 6/2004 | Lefavour et al. | 72/453.16 |
| 2001/0027676 | A1 | 10/2001 | Frenken | 72/453.15 |
| 2002/0007658 | A1 | 1/2002 | Amherd | 72/453.16 |

OTHER PUBLICATIONS 14,4V or 18V Ni-MH Battery Operated Hydraulic Tools, Dubuis Outillages 4 pages, Jan. 2002.

BATTERY POWERED HYDRAULIC TOOL

CROSS REFERENCE TO RELATED APPLICATION

This is a divisional patent application of copending U.S. patent application Ser. No. 10/818,196 filed Apr. 5, 2004, now U.S. Pat. No. 6,957,560. which is a continuation of U.S. patent application No. 10/080,281 filed Feb. 19, 2002, now U.S. Pat. No. 6,745,611.

BACKGROUND OF THE INVENTION

1. Field of the Invention

The present invention relates to battery powered hydraulic tools and, more particularly, to a tool which optimizes battery life and provides a quicker tool stroke.

2. Brief Description of Prior Developments

U.S. Pat. No. 5,657,417 discloses a hand held battery powered hydraulic tool for crimping electrical connectors. Traditional industry standard battery powered hydraulic crimping tools typically operate at 12 volt DC or 14.4 volt DC nominal voltage. There is a desire for a battery powered hydraulic crimping tool which can perform a crimp in a shorter amount of time than conventional tools. There is also a desire for a battery powered hydraulic crimping tool which can perform more crimps per battery charge than conventional tools.

SUMMARY OF THE INVENTION

In accordance with one aspect of the present invention, a battery powered hydraulic tool is provided including a frame; a battery connected to the frame; a motor connected to the frame and adapted to be powered by the battery; and a hydraulic pump connected to the motor by a gear reduction transmission. The motor and gear reduction transmission are adapted to output a torque of at least about 160 oz-in with the gear reduction transmission being adapted to provide a gear reduction of between about 10:1–15:1 and the hydraulic pump being adapted to output at least about 6000 psi of pressure.

In accordance with another aspect of the present invention, a battery powered hydraulic tool is provided comprising a frame having a hydraulic fluid conduit; a battery connected to the frame; a motor connected to the frame and adapted to be powered by the battery; and a hydraulic pump connected to the motor by a gear reduction transmission and connected to the hydraulic fluid conduit. The hydraulic pump comprises a pump piston with a diameter of the least about 0.29 in. The hydraulic pump can generate at least about 6000 psi pressure in the hydraulic fluid conduit. The motor and gear reduction transmission are adapted to generate at least about 160 oz-in of torque.

In accordance with another aspect of the present invention, a battery powered hydraulic electrical connector compression tool is provided comprising a frame; a ram movably connected to the frame; a battery connected to the frame; a motor connected to the frame and adapted to be powered by the battery; and a hydraulic drive system coupled to the motor by a gear reduction transmission. The hydraulic drive system is adapted to move the ram on the frame. The battery has a voltage of at least 16 volts. The motor and gear reduction transmission are adapted to drive the hydraulic drive system to move the ram more than 1.3 in. on the frame in less than 25 seconds and can produce at least about 6000 psi pressure in the hydraulic drive system.

In accordance with another aspect of the present invention, a battery powered hydraulic tool is provided comprising a frame; a battery connected to the frame; a motor connected to the frame and adapted to be powered by the battery; a hydraulic pump connected to the motor to be driven by the motor; and a system for protecting the motor from a current draw of more than a predetermined amperage. The battery has a voltage of at least 16 volts.

In accordance with another aspect of the present invention, a battery powered hydraulic tool is provided comprising a frame forming a hydraulic fluid conduit system; a battery connected to the frame; a drive system connected to the frame, the drive system comprising a motor and a hydraulic pump connected to the hydraulic fluid conduit system; a hydraulic poppet valve connected to the hydraulic fluid conduit system; and a controller adapted to sense a current drop of electricity to the motor when the poppet valve opens and adapted to deactuate the motor for a predetermined period of time.

In accordance with one method of the present invention, a method of operating a hand held battery powered hydraulic tool having a movable ram for crimping an electrical connector is provided comprising steps of rotating a drive shaft of a motor at a speed of at least 15,000 rpm for at least a portion of travel of the ram, the motor being powered by a battery having a voltage of at least 16 volts; driving a hydraulic pump of the tool by the motor to advance a ram of the tool at a speed of at least 0.005 ft/sec.; and producing a hydraulic pressure in the tool from the hydraulic pump of at least 6000 psi.

In accordance with another method of the present invention, a method of designing a hand held battery powered hydraulic tool is provided comprising steps of selecting a motor; selecting a battery with a predetermined voltage operable with the motor; selecting a desired maximum hydraulic system operating pressure; and determining a gear reduction ratio for a gear reduction transmission between the motor and a hydraulic pump of the tool, wherein the gear reduction ratio is determined based upon a desired torque of the transmission for a diameter of a pump piston of the hydraulic pump and, the selected desired maximum hydraulic system operating pressure divided by an available torque at peak efficiency for the selected motor.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
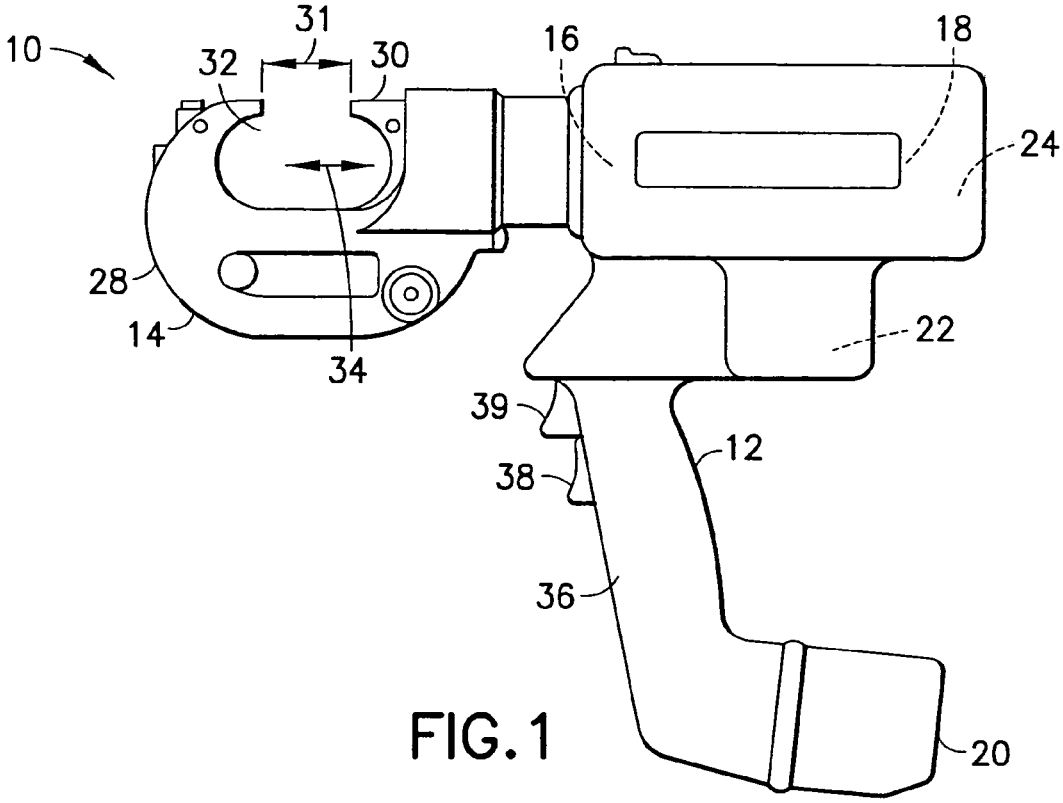
FIG. 1 is an elevational side view of a battery operated hydraulic electrical connector crimping tool incorporating features of the present invention.

Referring to FIG. 1, there is shown an elevational side view of a tool 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used. Features of the present invention could also be used in other types of tools, such as a battery operated hydraulic cutting tool or any other suitable type of battery operated hydraulic tool.

Figure 2:
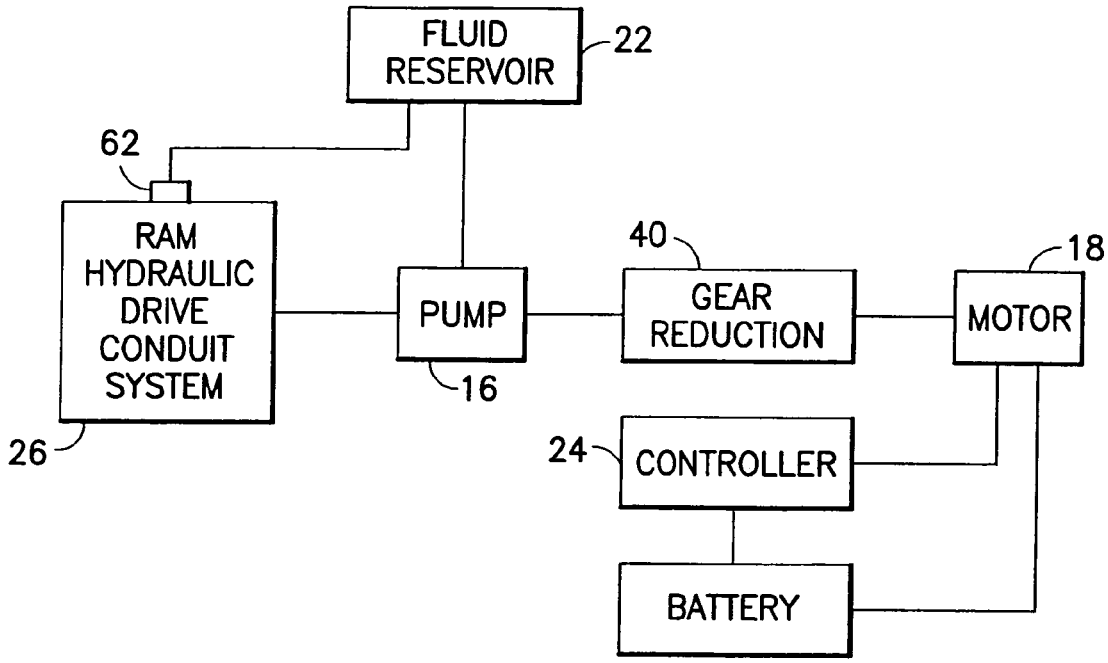
FIG. 2 is a block diagram of components in the tool shown in FIG. 1.

The tool 10 generally comprises a frame 12, a working head 14, a pump 16, a motor 18, a battery 20, a fluid reservoir 22 and a controller 24. In alternate embodiments, the tool could comprise additional or alternative components. Referring also to FIG. 2, the frame 12 forms a ram hydraulic drive conduit system 26. The working head 14 comprises a frame section 28 and a ram 30. The frame section 28 is stationarily connected to the front end of the frame 12, but could be rotatable. The ram 30 is movably connected to the section 28. In the exemplary embodiment shown, the section 28 and the ram 30 are adapted to removably receive conductor crimping dies (not shown) at a conductor receiving area 32.

The ram 30 is adapted to move forward and backward as indicated by arrow 34. The ram hydraulic drive conduit system 26 is connected between the pump 16 and the rear end of the ram 30. Hydraulic fluid pumped by the pump 16 against the rear end of the ram 30 causes the ram 30 to move forward. The tool 10 preferably comprises a spring (not shown) which is adapted, as is known in the art, to return the ram 30 to its reward home position when hydraulic fluid pressure is released. In the exemplary embodiment shown, the ram 30 has a rear end diameter of about 2 in. However, in alternate embodiments, the rear end of the ram could have any suitable size or shape for functioning as a hydraulic fluid contact surface. In the exemplary embodiment shown, the ram 30 is adapted to move a distance 31 about 1.7 in. between its rear position and its forward position. However, in alternate embodiments, the distance 31 could be any suitable distance, such as 1.3–2 inches for example.

The frame 12 forms a handle 36. The battery 20 is removably connected to the bottom of the handle 36. However, in alternate embodiments, the frame 12 could comprise any suitable type of shape. In addition, the battery 20 could be removably mounted to any suitable position on the frame. The battery 20 might also be fixedly mounted to the tool and not be removable. The battery 20 is preferably a rechargeable battery which can output a voltage of at least 16 volts. In one type of preferred embodiment, the battery 20 can output a voltage of about 18 volts. In another preferred embodiment, the battery 20 can output a voltage of about 24 volts. The handle 36 includes two user actuatable control triggers 38, 39. However, in alternate embodiments, any suitable type of user actuatable controls could be provided. The control triggers 38, 39 are operably coupled to the controller 24.

The motor 18 is coupled to the controller 24 and the battery 20. The controller 24 preferably comprises a printed circuit board. However, in alternate embodiments, any suitable type of controller could be provided. The motor 18 is controlled by the controller 24. The motor 18 is adapted to operate at a nominal voltage corresponding to the voltage of the battery 20. For example, if the battery 20 is adapted to output a voltage of about 18 volts, then the motor 18 would be adapted to operate at a nominal voltage of about 18 volts. In the exemplary embodiment shown, the battery 20 is an 18 V DC battery. The motor 18 preferably comprises a RS-775WC-8514 motor manufactured by Mabuchi Motor Co., Ltd. of Chiba-ken, Japan. However, in alternate embodiments, any suitable type of motor adapted to operate above a 16 V nominal voltage could be used. For example, in one type of alternate embodiment, the motor might comprise a RS-775VC-8015 motor, also manufactured by Mabuchi Motor Co., Ltd., and which has a nominal operating voltage of about 16.8 volts. As another example, the motor might comprise a motor adapted to operate at a 24 V nominal voltage. The output shaft of the motor 18 is connected to the pump 16 by a gear reduction or gearbox 40. Any suitable type of gear reduction assembly could be provided.

The motor 18 is adapted to function with an operating voltage between 6–20 volts. Under a no-load condition, such a motor 18 can operate at 19,500 rpm with a current of about 2.7 amps. At maximum efficiency, the motor 18 can operate at 17,040 rpm with a current of about 18.7 amps, a torque of about 153 mN-m (1560 g-cm), and an output of about 273 W.

Figure 3:
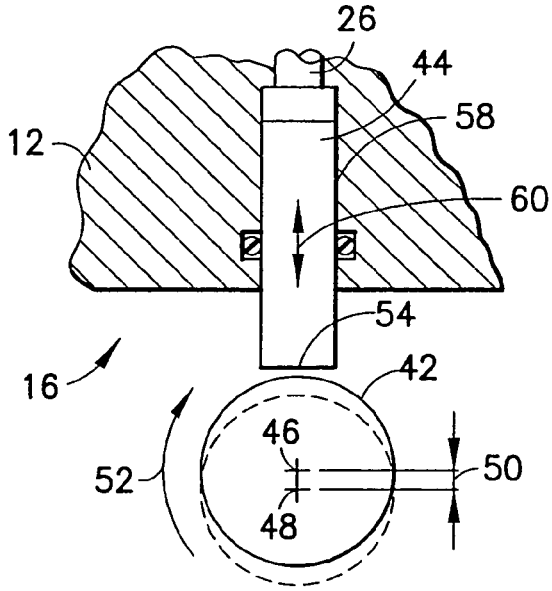
FIG. 3 is a partial schematic cross sectional view of the pump of the tool shown in FIG. 1.

Referring also to FIG. 3, in the exemplary embodiment shown the pump 16 comprises at the eccentric 42 and a pump piston 44. The eccentric 42 is connected to an output from the gear reduction 40. The eccentric 42 comprises a center 46 and a center axis of rotation 48. The center 46 is offset from the center axis of rotation 48 by an offset 50. Thus, as the eccentric 42 is rotated, as indicated by arrow 52, the eccentric moves between its solid line position shown in FIG. 3 and its dotted line position shown in FIG. 3.

The pump piston 44 comprises a rear end 54 which is located against the outer surface of the eccentric 42. The eccentric 42 functions as a rotating cam. In the exemplary embodiment shown, the pump 16 comprises means (not shown) which biases the piston 44 against the eccentric 42, such as a spring or hydraulic pressure for example. The piston 44 is slidably located in a hole 58 of the frame 12. The piston 44 is adapted to slide back and forth in the hole 58 as indicated by arrow 60. The hole 58 is connected to the ram hydraulic drive conduit system 26. In the exemplary embodiment shown, the piston 44 has a diameter of about a 0.312 in. However, in alternate embodiments, the piston 44 could have any suitable type of size or shape. For example, the piston 44 could have a diameter of between about 0.2–0.5 in. or perhaps even larger. In one type of preferred embodiment, the diameter is about 0.329–0.330 inch. In another type of preferred embodiment, the diameter is about 0.29 inch.

As the piston 44 moves in an outward direction in the hole 58, hydraulic fluid is sucked into the hole 58 from the fluid reservoir 22. As the piston 44 moves in an inward direction into the hole 58, hydraulic fluid in the hole 58 is pushed into the ram hydraulic drive conduit system 26. This hydraulic fluid subsequently pushes against the rear end of the ram 30 to move the ram 30 forward. Movement of the piston 44 between its inner most position and its outer most position is equal to twice the offset 50. In an alternate embodiment, any suitable type of hydraulic pump 16 could be provided. For example, the pump could comprise a cam located against the rear end 54 of the piston 44 rather than an eccentric.

The tool 10 is preferably adapted to operate at a maximum hydraulic pressure of about 8,000–10,000 psi. However, in alternate embodiments, the tool could be adapted to operate at any suitable type of maximum hydraulic pressure, such as 6000 psi or 11,000 psi. With the system described above, the ram 30 is adapted to advance at a speed of about 0.007202 ft/sec (0.08643 in/sec). A prior art 12 V battery operated hydraulic crimping tool, on the other hand, was limited to a ram advancement speed of about 0.00439 ft/sec (0.05273 in/sec). Thus, the speed of the ram 30 is much faster than the speed of the ram in a conventional prior art 12 V battery operated hydraulic crimp tool. The speed of the ram 30 is also faster than the speed of the ram in a conventional prior art 14.4 V battery operated hydraulic crimp tool.

Figure 4:
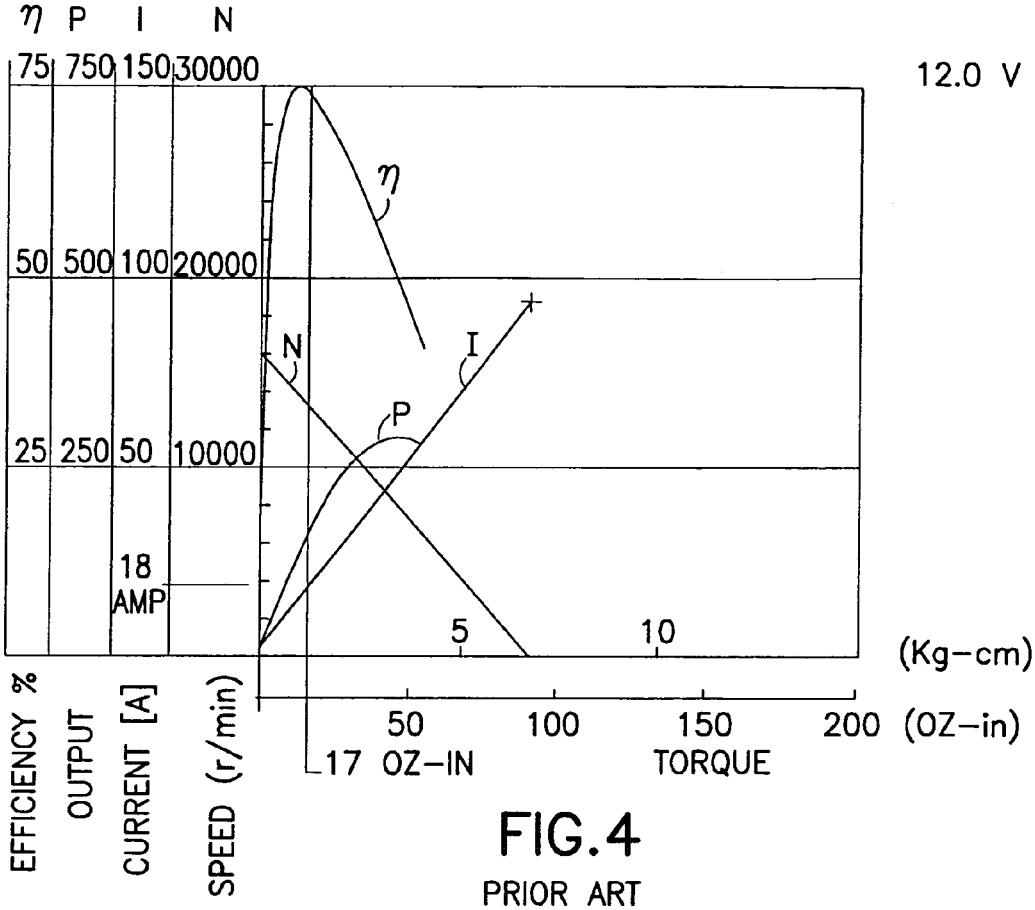
FIG.4 PRIOR ART
FIG. 4 is a chart of operating parameters for a prior art 12 Volt DC motor used in a prior art battery operated hydraulic compression tool.

Referring now to FIG. 4, a chart of the various operating parameters of a prior art 12 volt motor is shown. The parameters for the chart correspond to a RS-775VF-7513 12 volt motor used in a prior art battery operated hydraulic crimping tools. The motor operates at peak efficiency (about 75%) when it draws 18 amps.

Figure 5:
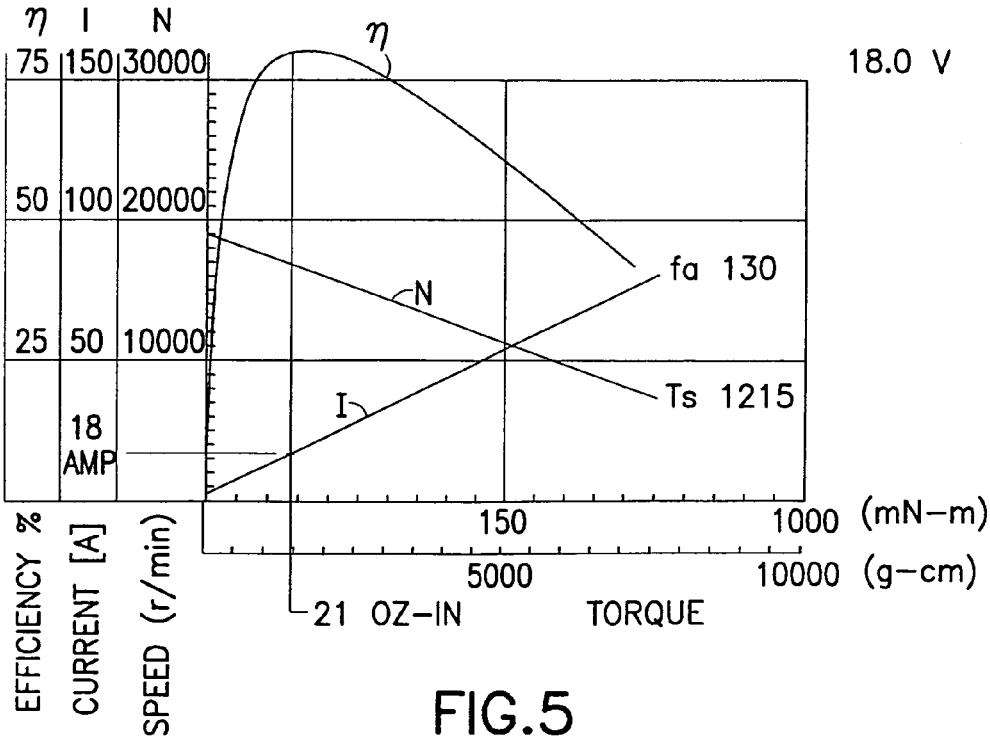
FIG. 5 is a chart of operating parameters for a new 18 Volt DC motor used in the tool shown in FIG. 1.

The present invention is intended to provide a battery powered hydraulic crimp tool which can operate at voltages greater than the industry standard. As noted above, traditional industry standard battery powered hydraulic crimp tools typically operate at 12 volt DC or 14.4 volt DC nominal voltage. There are recent technological advances in battery and DC motor technology that provide potential performance benefits if employed in a battery powered hydraulic crimping tool, specifically with the use of relatively higher operating voltages. For example, employing a nominal 18 volt DC battery and a DC motor rated for 18 volt DC operation, offers a significant advantage; namely, reduced crimp cycle time. Referring also to FIG. 5, a chart of various operating parameters for the new 18 volt RS-775WC-8514 motor is shown.

Recent developments in motor technology (higher operating voltages) offer a higher torque for a given current and higher efficiencies. A hydraulic crimping tool may be designed to operate at a current draw that matches peak efficiency for a motor. This can optimize crimps per battery charge. As an example, consider the 12 volt DC motor curve for the RS-775VF motor shown in FIG. 4. At peak efficiency the current draw would be approximately 18 amps with a motor speed of about 13,000 rpm and produce about 17 oz-in of torque. This torque value is relatively low to drive a reciprocating hydraulic piston pump, such as the pump shown in FIG. 3. Comparing this to the RS-775WC-8514 motor curve shown in FIG. 5, at peak efficiency the current draw would be approximately 18 amps with a motor speed of about 17,000 rpm and produce about 21 oz-in of torque.

As clearly seen, the 18 volt motor produces more torque than the 12 volt motor for a given current draw. In other words, a battery powered crimp tool operating at 18 volt DC would have more power available than the traditional 12 volt or 14.4 volt crimp tools (power=torque/time). It should also be noted that the above examples could use a larger cross sectional diameter piston pump and, thus, have a much shorter crimp cycle time, or use a gearbox with less reduction than that of the old 12 volt tools. In addition to the 18 volt operating voltage, there is also interest in other voltages greater than the industry standard 14.4 volt DC tool, up to and including a 24 volt DC systems for use in battery powered hydraulic crimp tools. Yet, with and despite all these benefits, higher operating voltages have not been adopted in the hydraulic tool art even though higher operating voltages have been adoption in other battery operated tools.

One of the reasons higher operating voltages have not been adopted in the hydraulic tool art before is because a suitable electric motor for a hand-held hydraulic tool, such as the RS-775WC-8514 motor or the RS-775VC-8015 motor, was not previously available. Another reason higher operating voltages have not been adopted in the hydraulic tool art is because of the unique problems that are encountered in battery operated hydraulic tools when attempting to use motors with higher nominal operating voltages. In particular, when a motor with an increased nominal operating voltage is attempted to be used, because of the fast increase in hydraulic pressure (due to the faster speed of the ram) and its effect on the motor, there is the potential problem of a current spike that could damage the motor. In addition, there is also the problem of having to redesign the entire "drive" specifications (gear box and hydraulic pump and motor) to achieve battery drain efficiency to prolong the number of battery crimps per battery charge.

The following illustrates a comparison of the differences between a 12 volt battery operated hydraulic crimp tool (using the RS-775VF motor) and a 18 volt battery operated hydraulic crimp tool (using the RS-775WC-8514 motor) Similar comparisons could be made with any battery operated hydraulic crimp tool adapted to operate at or above 16 volts. The comparison illustrated below assumes a maximum operating pressure of 8000 psi, a torque requirement of 170 oz-in to the piston pump, an 18 amp current profile during the entire crimp cycle, 2.2 ampere-hour energy density (2.2 Ah is a standard portable battery industry energy density), maximum or optimum use of energy density regardless of battery type or size, and a ram travel distance of 1.7 inches.

| | Speed (rpm) | Motor Torque (oz-in) | Gear Reduction | Crimp Time (seconds) | Gearbox Output Torque (oz-in) |
|---|---|---|---|---|---|
| 12 volt | 13000 | 17 | 10:1 | 32.24 | 170 |
| 18 Volt | 17000 | 21 | 8:1 | 19.67 | 168 |

For the 12 volt embodiment:
Crimp time=32.24 seconds
Energy Density: 2.2 Ah per battery charge, * 3600 seconds/hour=7,920 amp-seconds/charge
Current Draw 18 amps
Energy Density used per crimp:
32.24*18=580.32 amp-seconds/crimp
Number of crimps per battery charge:
7,920÷580.32=13.64 crimps/battery charge
For the 18 volt embodiment:
Crimp time=19.67 seconds
Energy Density: 2.2 Ah per battery charge, * 3600 seconds/hour=7,920 amp-seconds/charge
Current Draw=18 amps
Energy Density used per crimp:
19.67*18=354.06 amp-seconds/crimp
Number of crimps per battery charge:
7,920÷354.06=22.37 crimps/battery charge A 50% increase in battery voltage provides a 64% increase in crimps per battery charge.

It is clear from the example described above that the 18 volt crimp tool can perform more crimps in a shorter amount of time as a result of its relatively high torque and motor speed. In addition, since the crimp cycle time is shorter for the 18 volt system, the operator can get more crimps per battery charge.

In an alternate embodiment, the maximum torque requirement to the pump might be between about 260–290 oz-in, and preferably about 270–280 oz-in, such as 279 oz-in. However, any suitable maximum torque requirement to the pump might be required. The required gear reduction can obviously vary depending upon the pump's piston's diameter. For a piston diameter of about 0.312, as in the example noted above, and for a 279 oz-in required torque and the 18 V motor, the gear reduction would need to be about 13:1 (279÷21≅13.29). The gear reduction could preferably range between 10:1–15:1, such as 12:1 for a tool with about a 0.33 inch diameter piston pump. As opposed to the single stage pump in the exemplary embodiment, other known pumps used in hydraulic tools use a two-stage pump with two separated pumping surfaces for fast movement of the ram, similar to that disclosed in U.S. Pat. No. 5,979,215. The two surfaces might have a combined effective piston diameter of about 0.9 inch (0.307 inch and ⅝ inch). However, use of a multi-stage pump requires additional check valves and hydraulic conduits than a single stage pump. Thus, a tool with a multi-stage pump can be more expensive to manufacture than a tool with a single stage pump. However, the present invention could be used with a multi-stage pump.

The above calculations and cycle times are based on a 1.70 in. movable ram travel when subjected to constant flow pressure (8000 psi) cycle. Such a condition would rarely exist in actual operation. The conditions were established for comparison purposes only. In the real world of crimping, the pressure would ramp up during the crimping process. The pressure would not be constant as the conductor is being crushed. The actual crimp times would be somewhat reduced. Crimps per battery charge would increase since the power consumption would be less.

The number of crimps per battery charge is important for the operator. Typically, battery tools are supplied with two batteries and a battery charger. While the operator is crimping and discharging one battery, the second battery can be charged. One other important note is that there are alternative methods to change the crimp speed. As an example, a designer may increase the eccentric to increase pump piston stroke. In turn, this requires more torque and higher current draw. Current draw should be considered in conjunction with the motor efficiency to maximize crimps per charge. Changing the gear reduction can control current draw, but it also affects crimp speed. Another possible technique to change the crimp speed is to increase the pump's piston diameter. However, a piston pump's load will increase and will require more torque. Yet another version may be to decrease the movable ram diameter and operate at higher pressures. This too also requires more torque. Yet another method is to use a device as described in U.S. Pat. No. 5,979,215. However, it is believed that the best solution is to use a relatively higher voltage system such as one that operates at 18 volts or higher.

As seen in FIG. 2, the tool comprises a poppet valve 62. The poppet valve 62 is connected to the ram hydraulic drive conduit system 26. The poppet valve 62 is adapted to open when the conduit system 26 reaches a predetermined pressure, such as 8000–11,000 psi. When the poppet valve opens hydraulic fluid being pumped by the pump 16 can exit the conduit system 26 and return to the fluid reservoir 22. The poppet valve 62 can be adapted to generate an audible sound when it opens. This audible sound can signal to the user that the tool 10 has reached its maximum predetermined hydraulic pressure and, thus, that the crimp of the electrical connector is completed.

It may be desired to use a poppet valve which does not comprise a relatively loud audible sound when it opens. Even with a relatively loud poppet valve, in a noisy environment a user might not hear the poppet valve open. Thus, the user might continue to operate the motor and pump even though the crimp has been completed. This can reduce the working life of the battery 20 per battery charge. The present invention comprises a system for sensing when the poppet valve 62 opens; thus sensing when the tool has reached a predetermined hydraulic system pressure.

In the exemplary embodiment shown, the controller 24 is adapted to sense a current drop of electricity to the motor 18. When the poppet valve 62 opens, resistance to rotation of the motor 18 is reduced. Thus, the motor 18 requires less current to operate while the poppet valve is open. When the poppet valve opens the motor 18 draws less current. The controller 24 senses this current drop. When this current drop occurs, the controller 24 is adapted to automatically deactivate the motor 18 for a predetermined period of time. In a preferred embodiment, the predetermined period of time is about 2–3 seconds. However, in an alternate embodiment, any suitable type of predetermined period of time could be provided. In an alternate embodiment, the controller 24 could be adapted to deactuate the motor 18 until a reset button or procedure is performed by the operator. With this type of system, the user can sense that the motor 18 and pump 16 have stopped and does not need to rely on an audible signal being heard or a visual signal from an LED at the rear end of the tool. The user receives a tactile signal when the motor 18 and pump 16 stop. This type of system can help save battery energy.

Another problem which can occur in a battery operated hydraulic tool is damaged to the electric motor from a current spike, such as a current spike above 23 amps. A current spike might become more of a problem in a tool with a faster moving ram. When the ram encounters resistance from an electrical connector to be crimped, hydraulic pressure in the hydraulic system increases and the load on the motor increases. If this occurs abruptly, such as with a faster moving ram, damage to the electrical motor from a current spike might become an even more significant problem; especially in a relatively small motor such as in a hand held battery operated hydraulic crimping tool.

Figure 6:
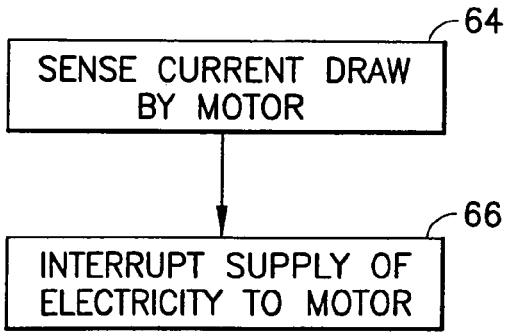
FIG. 6 is a block diagram of steps used in one method of the present invention.

The present invention uses two systems for protecting the motor from a current draw of more than a predetermined amperage. In a preferred embodiment, the predetermined amperage is about 23 amps. However, in alternate embodiments, any suitable type of predetermined amperage could be selected. The first system for protecting the motor comprises the controller 24 being adapted to sense a current draw by the motor and being adapted to interrupt supply of electricity to the motor if the current draw exceeds the predetermined amperage. Referring also to FIGS. 6, the controller 24 senses current draw by the motor as indicated by block 64 and interrupts supply of electricity to the motor as indicated by block 66. In an alternate embodiment, this first type of system might not be provided. Alternatively, any suitable type of system for protecting the motor from a current draw of more than a predetermined amperage could be provided.

The second system for protecting the motor from a current draw of more than a predetermined amperage comprises the cam offset 50 of the eccentric 42 relative to its axis of rotation 48 and the diameter of the pump piston 44 being selected to prevent the motor from exceeding the predetermined amperage current draw. However, this second type of system might not be provided, such as when the first type of system is provided.

Another potential problem regarding a current spike, and resulting damage to the motor, could occur when a user stops the tool after a crimp has started, but before the crimp has been completed. This tool scenario could cause a current spike to the motor and damage the motor. The controller 24 is preferably adapted to prevent a current draw of more than a predetermined amperage (such as 23 amps for example). Thus, the controller can protect the motor from a current spike in this type of start-stop-start tool use.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hand-held battery powered hydraulic tool comprising:

a frame;

a hydraulic pump in the frame;

an electric motor connected to the frame and operably coupled to the hydraulic pump to drive the hydraulic pump, wherein the electric motor is adapted to operate with a nominal voltage that is approximately 18 Volt DC or greater; and a rechargeable battery connected to the frame and coupled to the electric motor, wherein the battery comprises a voltage of at least about 18 Volts.

2. A hand-held battery powered hydraulic tool as in claim 1 further comprising a gear reduction transmission between the pump and the motor.

3. A hand-held battery powered hydraulic tool as in claim 2 wherein the gear reduction transmission is adapted to provide a fixed gear reduction of about 10:1 to about 15:1 and the hydraulic pump is adapted to output at least about 6000 psi of pressure.

4. A hand-held battery powered hydraulic tool as in claim 2 wherein torque output of the motor and the gear reduction transmission is at least about 260 oz-in of torque.

5. A hand-held battery powered hydraulic tool as in claim 2 wherein the gear reduction transmission is adapted to provide a gear reduction of at least about 12:1.

6. A hand-held battery powered hydraulic tool as in claim 2 further comprising a ram movably connected to the frame, the ram being moved by hydraulic pressure from the hydraulic pump, wherein the frame comprises a hydraulic conduit system, and wherein the hydraulic conduit system, the hydraulic pump, the motor and the gear reduction transmission are adapted to move the ram at a speed of at least about 0.007 ft/sec.

7. A hand-held battery powered hydraulic tool as in claim 1 wherein the hydraulic pump is adapted to output at least about 8000 psi of pressure.

8. A hand-held battery powered hydraulic tool as in claim 1 wherein the hydraulic pump comprises a pump piston with a diameter of less than about 0.35 inch.

9. A hand-held battery powered hydraulic tool as in claim 1 further comprising at least one system for protecting the motor from a current spike by preventing a current draw of more than a predetermined amperage.

10. A hand-held battery powered hydraulic tool as in claim 9 wherein the at least one system for protecting the motor from a current spike comprises two systems.

11. A hand-held battery powered hydraulic tool comprising:

a frame;

a hydraulic pump in the frame;

an electric motor connected to the frame and operably coupled to the hydraulic pump to drive the hydraulic pump, wherein the electric motor is adapted to operate at a nominal voltage of about 18 Volt DC or greater; and a rechargeable battery connected to the frame and coupled to the electric motor, wherein the battery comprises a voltage of at least about 18 Volts.

12. A hand-held battery powered hydraulic tool as in claim 11 wherein the hydraulic pump comprises a pump piston with a diameter of less than about 0.4 in., wherein the hydraulic pump can generate at least about 6000 psi pressure, and wherein the motor and a gear reduction transmission are adapted to generate at least about 160 oz-in of torque.

13. A hand-held battery powered hydraulic tool as in claim 11 wherein torque output of the motor and a gear reduction transmission between the motor and the pump is about 270–280 oz-in of torque.

14. A hand-held battery powered hydraulic tool as in claim 11 further comprising a gear reduction transmission between the motor and the pump which is adapted to provide a fixed gear reduction of between about 12:1 to about 15:1.

15. A hand-held battery powered hydraulic tool as in claim 11 wherein the hydraulic pump is adapted to output at least 8000 psi of pressure.

16. A hand-held battery powered hydraulic tool as in claim 11 further comprising a ram movably connected to the frame, the ram being moved by hydraulic pressure from the hydraulic pump, and wherein the hydraulic fluid conduit, the hydraulic pump, the motor and a gear reduction transmission are adapted to move the ram at a speed of about 0.007 ft/sec or greater.

17. A hand-held battery powered hydraulic tool as in claim 11 further comprising at least one system for protecting the motor from a current spike by preventing a current draw of more than a predetermined amperage.

18. A hand-held battery powered hydraulic tool as in claim 17 wherein the at least one system for protecting the motor from a current spike comprises two systems.

19. A hand-held battery powered hydraulic tool comprising:

a frame;

a hydraulic pump in the frame;

an electric motor connected to the frame and operably coupled to the hydraulic pump to drive the hydraulic pump, wherein the electric motor is adapted to operate at a nominal voltage of at least 18 Volt DC; and a rechargeable battery connected to the frame and coupled to the electric motor, wherein the battery comprises a voltage of at least about 18 Volts.

* * * * *